US006621219B2

(12) United States Patent
Allen et al.

(10) Patent No.: US 6,621,219 B2
(45) Date of Patent: Sep. 16, 2003

(54) THERMALLY INSULATING LEAD WIRE FOR CERAMIC METAL HALIDE ELECTRODES

(75) Inventors: Gary R. Allen, Chesterland, OH (US); James Howard, Shaker Heights, OH (US); James A. Leonard, Shaker Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/751,295

(22) Filed: Dec. 28, 2000

(65) Prior Publication Data

US 2002/0084754 A1 Jul. 4, 2002

(51) Int. Cl.[7] ..... H01J 17/18
(52) U.S. Cl. ..... 313/623; 313/624
(58) Field of Search ..... 313/30, 31, 33, 313/34, 566, 567, 627, 623, 634, 636

(56) References Cited

U.S. PATENT DOCUMENTS 5,001,397 A * 3/1991 der Kinderen, deceased .... 313/344
5,557,169 A * 9/1996 Van Lierop et al. ..... 313/623
5,793,161 A * 8/1998 Peeters et al. ..... 313/344
5,859,492 A * 1/1999 Austad et al. ..... 313/243
5,866,982 A * 2/1999 Scott et al. ..... 313/493
5,962,972 A * 10/1999 Engels et al. ..... 313/344
5,994,839 A * 11/1999 Yamamoto et al. ..... 313/25
6,027,389 A * 2/2000 Miyazawa et al. ..... 445/22
6,075,314 A * 6/2000 Huettinger et al. ..... 313/326
6,169,367 B1 * 1/2001 Muto et al. ..... 313/25
6,249,086 B1 * 6/2001 Honda et al. ..... 313/352

* cited by examiner

*Primary Examiner*—Don Wong
*Assistant Examiner*—Minh D. A.
(74) *Attorney, Agent, or Firm*—Fay, Sharpe, Fagan, Minnich & McKee, LLP

(57) ABSTRACT

A significant reduction in thermal energy loss along the legs or ends of the arctubes in a CMH lamp is achieved in the present invention. The diameter of a mandrel (36, 40) is significantly reduced for CMH lamps. Either a single overwind (32) or multiple overwind layers (42) are used. Since the thermal conductivity of the mandrel greatly exceeds that of the overwind, the axial thermal conductivity will scale like the cross sectional area of the mandrel alone.

19 Claims, 2 Drawing Sheets

THERMALLY INSULATING LEAD WIRE FOR CERAMIC METAL HALIDE ELECTRODES

BACKGROUND OF THE INVENTION

1. Field of the Invention

This invention pertains to improving the performance of ceramic metal halide (CMH) lamps by reducing axial heat loss along an electrode or lead wire assembly. More particularly, the invention relates to controlling thermal conduction or axial heat loss along the leg of an arctube, particularly for lower lamp wattages, although the invention may have application in other CMH lamp sizes or other lamps.

2. Discussion of the Art

CMH lamps have become increasingly popular due to significant customer benefits. Traditionally, quartz arctubes have been commonly used in arc discharge lamps. More recently, these are being replaced by CMH lamps that use a ceramic arctube. CMH lamps provide better color uniformity and stability, as well as increased lumens per watt, relative to traditional arc discharge lamps. A ceramic arctube can operate at a higher temperature than a comparable quartz arctube. It also has a reduced rate of sodium loss.

In high intensity discharge lamps, efficacy and lamp performance are affected by the loss of energy by thermal conduction along the legs, or ends, of the arctube. Managing the energy losses is necessary to get optimal lamp performance. Thermal management is accomplished by designing the various parts of the lamp to limit or control the power loss through that component. The leadwire connects the arc tube to mounting frame. Heat from the ceramic body and from the electrode tip are conducted through the lead wire away from the arc tube. Controlling the axial and radial thermal conductivity of the leadwire can significantly affect lamp performance.

This efficacy and performance penalty is more pronounced at lower lamp wattages and smaller arctube sizes. This is believed to result from the inability to reduce the dimensions of the legs in scale with the reduced dimensions of the arc chamber. Limitations of the material such as the strength, wall thickness, opening size or diameter, and the manufacturing processes all impose limitations that impact on the efficacy of the lamp at the lower lamp wattages and smaller arctube sizes. In high wattage lamps, the internal diameter of the leg must be large enough to pass the electrode tips. This also limits how small one could make the lead wire and thus limits the ability to control thermal losses by the conventional means of reducing lead wire diameter.

A standard CMH lead wire has a three piece construction. An electrode tip preferably constructed from tungsten is supported at one end of a shaft or mandrel typically constructed of Molybdenum. The mandrel is axially joined or welded to a niobium outer lead to which the lamp mount is attached. The lead wire assembly is hermetically sealed inside a hollow, cylindrical ceramic leg of the arctube, typically along the length of the niobium section and covering the Niobium-Molybdenum weld. The preferred method of sealing the interior chamber is accomplished through frit sealing; however, it will be appreciated that other sealing processes known in the art could also be used. As noted above, it is desirable to limit the axial heat flux along the arctube leg by designing the leg structure to have a reduced thermal conductivity. It has been observed that axial heat loss by thermal conduction along the lead wire assembly usually exceeds the axial heat loss by conduction down the ceramic leg. Thus it is desirable to address the axial heat loss in either the molybdenum or niobium sections of the mandrel. A significant reduction in the axial heat loss along the mandrel would proportionally reduce the loss of lamp power along the arctube leg.

In a conventional CMH lamp, the molybdenum section includes a relatively large diameter mandrel with a smaller diameter overwind. For example, a General Electric 39 watt CMH lamp has a mandrel diameter along the order of 0.016". The overwind component is preferably a molybdenum wire and has a dimension along the order of 0.0045". Thus, the total diameter is on the order of 0.025" (0.016+2*0.0045). The overwind has traditionally been added to the mandrel primarily to alleviate thermal expansion stresses that exist between the molybdenum and the ceramic leg. As will be appreciated, heat is easily conducted both axially and radially through the mandrel. It has been determined that the axial and radial heat conduction is much lower through the overwind than through the mandrel as a result of the helical geometry of the overwind. On the other hand, the overall diameter of the molybdenum portion, i.e. the mandrel and the overwind, must maintain a snug fit with the inside diameter of the ceramic leg of the arctube. The traditional solution, therefore, is to reduce the overall diameter of the molybdenum. As noted above, this is not possible in some instances due to limitations on the minimum manufactured inside diameter of the ceramic leg or for other reasons such as having minimum clearance for the electrode tips to be inserted into the arc tube.

Accordingly, a need exists to provide a molybdenum section with a minimum mandrel diameter that still adheres to the overall diameter required for the molybdenum section and satisfies manufacturing constraints in the winding of the overwind on to small mandrels.

BRIEF SUMMARY OF THE INVENTION

An improved molybdenum lead wire assembly for CMH electrodes is provided that addresses the thermal conduction concerns along the legs of the arc tube.

In an exemplary embodiment of the invention, a ceramic metal halide lamp includes an envelope having an arc discharge chamber. First and second openings communicate with and extend from the discharge chamber. First and second electrode leads are received in the first and second openings, respectively. First ends of the electrode leads extend into the discharge chamber. The electrode leads each have a reduced diameter mandrel with a large overwind such that the combined component diameter fits snugly inside the ceramic leg.

In another exemplary embodiment, double or multiple overwinds are provided on the small mandrel. Minimizing the diameter of the mandrel and increasing the diameter of the overwind component while keeping the total component outer diameter constant, by either using a single large overwind or multiple, smaller overwinds, beneficially reduces heat loss along the arctube leg opening. For small mandrels, multiple small overwinds may be more easily manufactured.

A principal advantage of the invention is increased efficacy of a CMH lamp.

Another advantage of the invention resides in the reduced axial heat loss. This can allow for a larger arc chamber which generally gives better lumen maintenance and longer life, particularly in low wattage lamps.

Still another advantage of the invention relates to the improved performance of extra low wattage CMH lamps.

Since the majority of the halide dose in a CMH lamp resides in the legs of the arc tube, minimizing the axial heat loss from the leg can increase the effective temperature of the halide dose which results in increased color rendering index (CRI) and other performance characteristics of the lamp.

Still another advantage is reduced seal glass temperatures that result in lamps with longer life. Alternatively, this allows the lamp to have shorter legs with the same lamp life, thus allowing the creation of more compact light sources.

Still other advantages and benefits will become apparent to those skilled in the art upon a reading and understanding of the following detailed description.

DETAILED DESCRIPTION OF THE INVENTION

Figure 1:
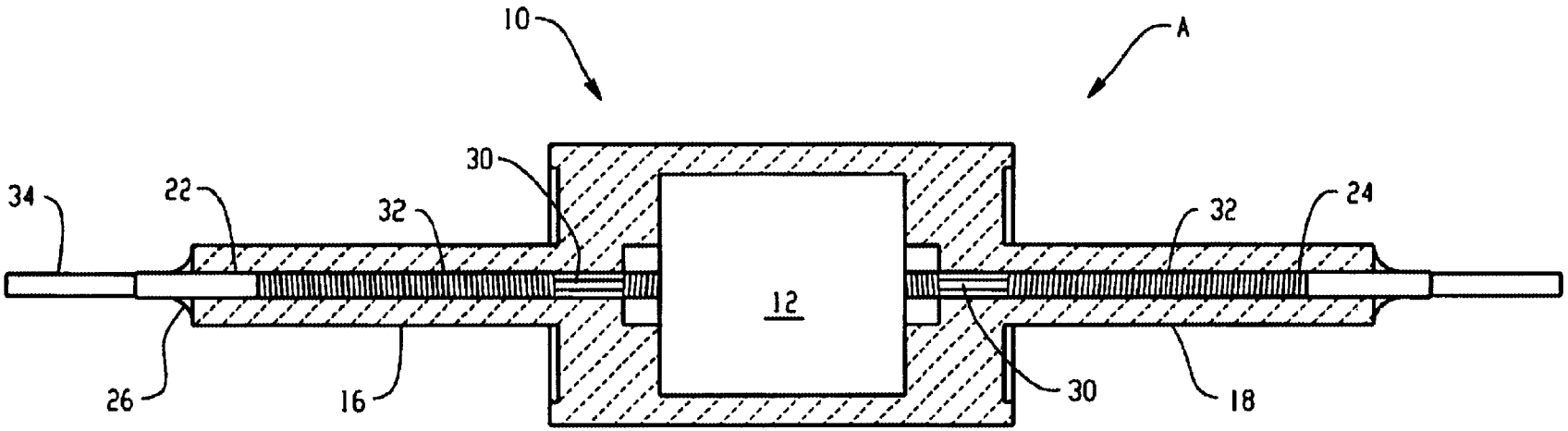
FIG. 1 is an elevational view of the lamp assembly according to a preferred embodiment of the present invention.

Referring now to the drawings, FIG. 1 shows a lamp assembly A having a hollow body or lamp envelope 10 defining an interior cavity or chamber 12. The lamp body 10 or ceramic arctube, is a conventional, well known structure to those skilled in the art. The interior chamber 12 communicates with first and second legs 16, 18 extending, for example, from opposite ends of the envelope. The legs have openings that receive first and second electrode/lead wire assemblies 22, 24 that are electrically connected to an external power source (not shown). Inner ends of the lead wire assemblies terminate within the chamber in space relation so that an arc discharge formed therebetween ionizes a fill gas contained in the sealed chamber and emits light in a manner well known in the art. Leg openings 26 are sealed at the entry point of the electrode lead wires. A preferred method of sealing the interior chamber is a frit sealing, typically along a niobium portion of the lead wire assembly.

Figure 2:
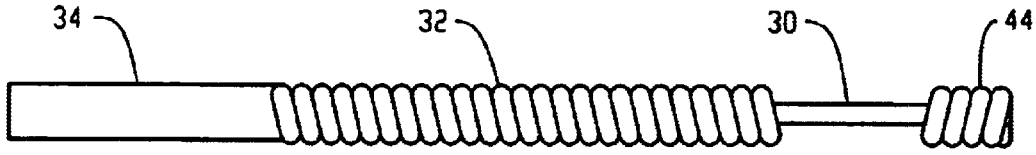
FIG. 2 is an elevational view of a lead wire/electrode assembly.

FIG. 2 is an elevational view partly in section of a lead wire/electrode assembly. It typically comprises three (3) parts. A niobium outer lead 34 is coaxially joined or welded to an intermediate component typically comprising a Molybdenum overwind 32 on a molybdenum mandrel 36. This intermediate component is coaxially joined or welded to an electrode that comprises a shank 40, typically made of tungsten, with a coil 42 wound on the end, also typically of tungsten.

Figure 3:
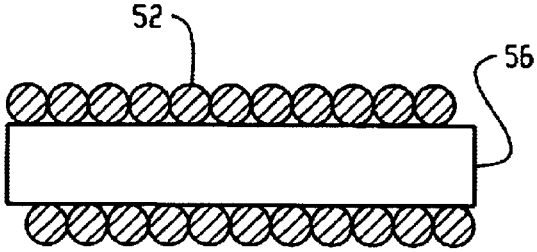
FIG. 3 is an elevational view partly in section of the intermediate portion of an electrode lead wire typical of prior art.

FIG. 3 illustrates a sectional view of the intermediate portion of the lead wire assembly typical for prior art. This shows a small overwind 52 on a large diameter mandrel 56.

Figure 4:
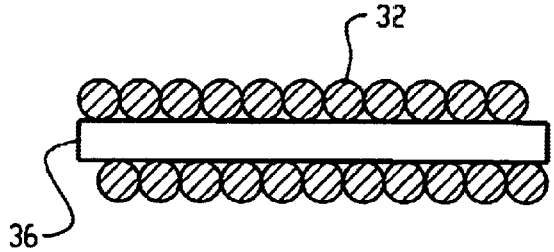
FIG. 4 is an elevational view partly in section of an electrode lead wire assembly in accordance with an exemplary embodiment of the present invention.

FIG. 4 illustrates a sectional view of the intermediate portion of the lead wire assembly. This shows the overwind 32 on the mandrel 36. In this invention, the mandrel diameter is reduced significantly over prior art while maintaining the total combined diameter such that the component fits snugly inside the ceramic leg. The overwind preferably has a helical conformation that extends axially and radially around the mandrel. By reducing the diameter of the mandrel, the cross sectional area of the mandrel is likewise proportionally reduced. The overwind, though, because of its helical conformation, already manifests a distinct reduction in thermal conduction along the length of the legs relative to the mandrel portion. It is estimated that the helical nature of the overwind causes its effective axial thermal conductivity to be on the order of one one-hundredth ($1/100^{th}$) of that of the mandrel. Thus, the thermal conductivity of this part of the leadwire is determined almost entirely by that of the mandrel. Reducing the mandrel diameter, thus its cross sectional area, effectively reduces the thermal conductivity of this component even when the diameter of the overwind wire is increased or when multiple overwinds are used to maintain the total component diameter constant to fit snugly in the ceramic leg.

In the prior art the ratio of the overwind diameter to the mandrel diameter is equal to 1:3 and mandrel diameter was approximately 60% of the ceramic leg inner diameter (ID). In the preferred embodiment, this ratio is about 1:1 and the mandrel diameter is reduced to approximately 30% of the leg ID. In a particular embodiment, the ceramic leg ID is approximately 0.018". In this invention, a molybdenum portion 36 of the mandrel has, for example, a diameter of 0.006" as shown in FIG. 3. As noted above, in the extra low wattage CMH lamps, dimensions of the ceramic leg, opening, and metal lead wires cannot be automatically reduced in amounts sufficient to prevent excessive heat loss along the legs. Nevertheless, this mandrel diameter is a significant reduction over the prior art where the mandrel diameter would have been 0.012". On the other hand, the opening through the leg is not reduced as much so the overwind 32 is a wire having a diameter of 0.006". This results in a total diameter of 0.018" defined by the combined dimension of the mandrel and twice the overwind diameter. This reduces the mandrel cross sectional area to one-fourth (¼) of that dictated by the prior art and thus, reduces the axial heat conduction losses significantly.

In another exemplary embodiment, the mandrel is slightly larger. That is in another preferred embodiment, the mandrel has a diameter of 8 mils (0.008"). The overwind is still relatively large but is slightly reduced to that described above. Hence a dimension along the order of 5 mils (0.005") is contemplated so that the total diameter is, again, 18 mils (0.018").

Figure 5:
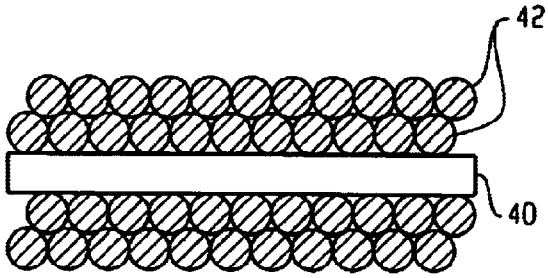
FIG. 5 is a an elevational view partly in section of an electrode lead wire assembly with a double overwind in accordance with another exemplary embodiment of the present invention.

According to the exemplary embodiment of FIG. 5, the mandrel diameter is again significantly reduced. Here the molybdenum mandrel 40 has a diameter of four mils (0.004"). This embodiment illustrates the use of multiple overwinds. In this arrangement two layers of the same overwind diameter are preferably used. The diameter of the overwind wire is 3.5 mils (0.0035") to achieve a total diameter, again, of eighteen mils (0.018").

Figure 6:
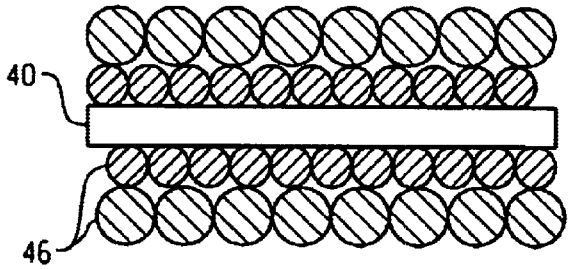
FIG. 6 is an elevational view partly in section of an electrode lead wire assembly with a double overwind where the two windings are of different diameter in accordance with another exemplary embodiment of the present invention.

FIG. 6 illustrates another exemplary embodiment where there are two overwinds 46 of different diameter wire. This embodiment allows for the total component diameter to be larger for a given mandrel diameter than would be possible using the same size wire for both overwinds. The reason for using different size overwind sires is that there is a limit on the ratio of the overwind wire diameter to the diameter of the helix that can be formed by winding it on a mandrel that is, the mandrel diameter. This limit is approximately 1:1. The overwind is even easier to manufacture when this ratio is smaller. Thus, a small overwind wire diameter may be used on a small mandrel for the first overwind, and larger wire may used for the second overwind because it is winding about the combined diameter of the mandrel and the first overwind.

Figure 7:
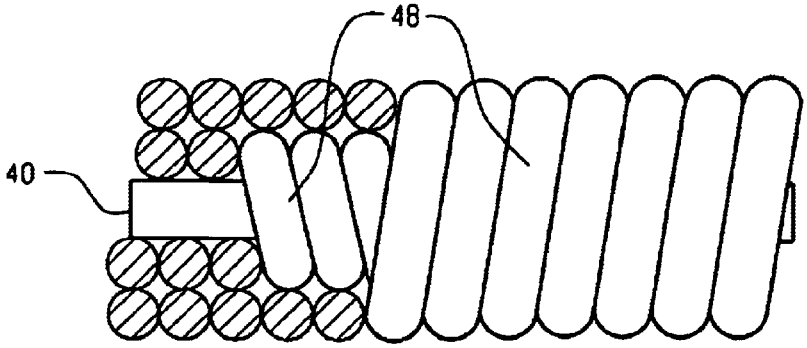
FIG. 7 is an elevational view partly in section of an electrode lead wire assembly with a double overwind where the two windings are wound in different directions (counter wound) in accordance with another exemplary embodiment of the present invention.

FIG. 7 illustrates another exemplary embodiment of the invention when the mandrel 40 has two overwinds 48 but the two wires are wound in opposite directions (counter wound). This arrangement might be more easily manufactured than the cowound component described previously. This arrangement would also provide reduced radial thermal conductivity and increased interstitial space between the windings as compared to a cowound winding because the top layer only makes contact with the bottom layer at intersection points rather than continually along the length of the helix.

The dimensions associated with the embodiments described in FIGS. 3–6 should be compared to the dimensions of a molybdenum section in, for example, a standard 39 watt CMH lamp lead wire. Such a lamp, manufactured and sold by GE Lighting, has a mandrel having a diameter of sixteen mils (0.016")—at least twice, or even four times, the mandrel diameters noted above. As a result of the present invention, a significant reduction in the thermal conduction passing axially along the arctube leg can thereby be achieved.

The invention has been described with reference to the preferred embodiments. Obviously, modifications and alterations will occur to others upon a reading and understanding of the specification. For example, different types of materials may be used for the mandrel, electrode tip, and overwind component. Likewise, different dimensional embodiments could be used. The invention is intended to include all such modifications and alterations in so far as they come within the scope of the appended claims and the equivalents thereof.

What is claimed is:

1. A ceramic metal halide lamp comprising: an envelope having an interior chamber disposed therein; first and second legs extending from the envelope and having openings extending therethrough; and first and second electrode leads received in the opening of the first and second electrode legs, respectively, and having first ends extending into the chamber, the first and second electrode leads including a mandrel and an overwind component having a combined dimension substantially filling the opening in the legs, the mandrel having a diameter less than or equal to 60% of a diameter of the leg opening.

2. The ceramic metal halide lamp of claim 1 wherein the overwind component is a wire helically wrapped around and along the mandrel.

3. The ceramic metal halide lamp of claim 2 wherein the helically wrapped wire diameter is chosen such that the total component diameter fits snugly in the ceramic leg.

4. The ceramic metal halide lamp of claim 3 wherein the overwind component is formed from a wire having a diameter no greater than the mandrel.

5. A ceramic metal halide lamp comprising: an envelope having an arc discharge chamber; first and second openings communicating with and extending from the arc discharge chamber; and first and second electrode leads received in the first and second openings, respectively, and having first ends received in the arc discharge chamber, the first and second electrode leads each having a reduced diameter mandrel and first and second layers of an overwind component received over the mandrel; wherein the reduced diameter of the mandrel is less than or equal to 60% of a diameter of the leg opening.

6. The ceramic metal halide lamp of claim 5 wherein the overwind component is a wire wrapped around the mandrel.

7. The ceramic metal halide lamp of claim 6 wherein the wire is helically wound around the mandrel.

8. The ceramic metal halide lamp of claim 7 wherein the first and second layers have substantially the same thickness.

9. The ceramic metal halide lamp of claim 8 wherein the first and second layers are axially coextensive and wound in the same direction.

10. The ceramic metal halide lamp of claim 8 wherein the first and second layers are axially coextensive and wound in opposite directions.

11. The ceramic metal halide lamp of claim 7 wherein the first and second helically wrapped layers use substantially different diameter wire.

12. The ceramic metal halide lamp of claim 11 wherein the first and second layers are axially coextensive and wound in the same direction.

13. The ceramic metal halide lamp of claim 11 wherein the first and second layers are axially coextensive and wound in opposite directions.

14. A method of manufacturing a low wattage ceramic metal halide lamp having reduced thermal energy loss through electrode leads that include a mandrel and an overwind component each with a first end extending into a discharge chamber and a second end extending through an opening of predetermined dimension communicating with the discharge chamber, the method comprising the steps of:

minimizing a diameter of the mandrel; and increasing a diameter of the overwind component;

wherein the diameter of the mandrel is less than or equal to 60% of a diameter of the leg opening.

15. The method of claim 14 comprising the further step of providing multiple layers of the overwind component.

16. The method of claim 15 wherein the providing step includes using substantially the same thickness for the multiple layers of the overwind component.

17. The method of claim 16 wherein the providing step includes using substantially the different thickness for the multiple layers of the overwind component.

18. The method of claim 16 wherein the providing step includes winding the multiple layers of the overwind component in the same direction.

19. The method of claim 16 wherein the providing step includes winding the multiple layers of the overwind component in the opposite direction.

* * * * *